US010960998B2

(12) United States Patent
Nicholson

(10) Patent No.: US 10,960,998 B2
(45) Date of Patent: Mar. 30, 2021

(54) METHODS AND APPARATUSES FOR SECURING A PALLETIZED LOAD WITH STRETCH FILM

(71) Applicant: Phoenix Wrappers ULC, Laval (CA)

(72) Inventor: Graham Nicholson, St. Joseph-du-Lac (CA)

(73) Assignee: Phoenix Wrappers ULC, Laval (CA)

( * ) Notice: Subject to any disclaimer, the term of this patent is extended or adjusted under 35 U.S.C. 154(b) by 179 days.

(21) Appl. No.: 16/133,927

(22) Filed: Sep. 18, 2018

(65) Prior Publication Data

US 2019/0084703 A1 Mar. 21, 2019

Related U.S. Application Data

(60) Provisional application No. 62/559,731, filed on Sep. 18, 2017.

(51) Int. Cl.

| | |
|---|---|
| ***B65B 11/58*** | (2006.01) |
| ***B65B 61/06*** | (2006.01) |
| ***B65B 11/02*** | (2006.01) |
| ***B65B 11/00*** | (2006.01) |
| ***B65B 11/04*** | (2006.01) |

(52) U.S. Cl.

CPC ..... *B65B 11/585* (2013.01); *B65B 11/006* (2013.01); *B65B 11/025* (2013.01); *B65B 11/045* (2013.01); *B65B 61/06* (2013.01); *B65B 2220/06* (2013.01)

(58) Field of Classification Search

CPC ... B65B 11/585; B65B 11/006; B65B 11/045; B65B 61/06; B65B 2220/06

USPC ..... 53/399

See application file for complete search history.

(56) References Cited

U.S. PATENT DOCUMENTS

| | | | | |
|---|---|---|---|---|
| 4,726,172 A | | 2/1988 | Widenbäck | |
| 5,131,209 A | | 7/1992 | Schreiber et al. | |
| 5,168,685 A | * | 12/1992 | Suzuki | B65B 11/045 53/141 |
| 5,447,009 A | | 9/1995 | Oleksy et al. | |
| 5,850,918 A | | 12/1998 | Pienta | |
| 6,185,914 B1 | | 2/2001 | Mackie | |
| 6,745,544 B2 | * | 6/2004 | Matsumoto | B65B 11/006 53/176 |

(Continued)

FOREIGN PATENT DOCUMENTS

DE 202011051429 U1 12/2011

*Primary Examiner* — Robert F Long
*Assistant Examiner* — Xavier A Madison
(74) *Attorney, Agent, or Firm* — Suiter Swantz pc llo

(57) ABSTRACT

A method for securing a palletized load is provided. The method comprises dispensing a first stretch film vertically inserted over a first support member, dispensing a second stretch film having an upper lateral side edge and a lower lateral side edge and being vertically inserted over a second support member, edging at least one of the upper lateral side edge and the lower lateral side edge of the second stretch film to obtain an edged second stretch film, partially overlapping the edged second stretch film and the first stretch film, passing the combined stretch film through a pre-stretcher, and wrapping the combined stretch film around the palletized load. The height of the stretch film can be adjusted using a height adjustment device. A third stretch film can be dispensed and combined with the first and second stretch films.

22 Claims, 9 Drawing Sheets

(56) References Cited

U.S. PATENT DOCUMENTS

| | | | | |
|---|---|---|---|---|
| 6,910,315 | B2 | 6/2005 | Suolahti | |
| 7,540,128 | B2 | 6/2009 | Lancaster, III et al. | |
| 7,568,327 | B2 | 8/2009 | Lancaster, III et al. | |
| 7,581,368 | B1 | 9/2009 | Bison | |
| 7,707,802 | B2 | 5/2010 | Forrest | |
| 7,908,831 | B1 * | 3/2011 | Dugan | B65B 11/006 53/587 |
| 8,046,975 | B1 | 11/2011 | Bison | |
| 8,053,056 | B2 * | 11/2011 | Heikaus | B65D 75/006 428/138 |
| 8,080,304 | B2 | 12/2011 | Clarke | |
| 8,549,819 | B1 | 10/2013 | Bison | |
| 8,707,664 | B1 * | 4/2014 | Bison | B65B 11/585 53/441 |
| 8,984,848 | B2 * | 3/2015 | Bison | B65B 11/045 53/589 |
| 9,254,931 | B2 | 2/2016 | Bison | |
| 9,802,722 | B1 | 10/2017 | Bison | |
| 2008/0209859 | A1 * | 9/2008 | Vanderheiden | B65B 11/025 53/399 |
| 2011/0088359 | A1 * | 4/2011 | Brocard | B65B 11/025 53/461 |

* cited by examiner

METHODS AND APPARATUSES FOR SECURING A PALLETIZED LOAD WITH STRETCH FILM

RELATED PATENT APPLICATION

This application claims priority under 35 USC § 119(e) of U.S. provisional patent applications 62/559,731 filed on Sep. 18, 2017, the specification of which is hereby incorporated by reference.

TECHNICAL FIELD

The technical field generally relates to methods and apparatuses for securing products on a pallet. More particularly, the technical field relates to methods and apparatuses for wrapping a palletized load with stretch film.

BACKGROUND

A palletized load, i.e., an assembly of products stacked over a pallet, can be sealed, stabilized and/or protected using stretch film made of plastic and supplied from a stretch film roll or dispenser. The stretch film is wrapped around the palletized products under tension, which contributes to anchor and consolidate the products onto the pallet, even when the products have an irregular shape, and also prevents the products from shifting off of the pallet when the pallet is moved. Different techniques exist to wrap the stretch film around a palletized load, and can include dispensing the stretch film from a stretch film roll to wrap the stretch film around the palletized load, and moving the stretch film support up and down along a vertical axis to wrap the entire height of the palletized load. The stretch film can be wrapped around the palletized load a number of times depending on the protection wanted.

However, since stretch film is made of a thin film of plastic and depending on how it is applied and wrapped around the palletized load, the stretch film can get damaged or punctured, for instance during transport, or may rupture if wrapped around the palletized load using a tension that is too high.

Therefore, there is still a need for improved methods and apparatus for dispensing stretch film around a palletized load to overcome at least some of the drawbacks mentioned above.

SUMMARY

In accordance with a first aspect, there is provided a method for securing a palletized load. The method comprises the steps of: dispensing a first stretch film having a first width from a first stretch film roll vertically inserted over a first support member; dispensing a second stretch film having a second width and comprising an upper lateral side edge and a lower lateral side edge opposite the upper lateral side edge from a second stretch film roll vertically inserted over a second support member; edging at least one of the upper lateral side edge and a lower lateral side edge of the second stretch film to obtain an edged second stretch film, the second width of the edged second stretch film being narrower than the first width of the first stretch film; partially overlapping the edged second stretch film and the first stretch film, comprising positioning the edged second stretch film at a given height along the first width of the first stretch film to obtain a combined stretch film; passing the combined stretch film through a pre-stretcher; and wrapping the combined stretch film around the palletized load.

In an embodiment, both the upper lateral side edge and the lower lateral side edge of the second stretch film are edged.

In an embodiment, the method comprises the step of dispensing a third stretch film comprising two opposite lateral side edges from a third stretch film roll vertically inserted over the second support member or over a third support member, comprising positioning the third stretch film at a given height along the first width of the first stretch film.

In an embodiment, the method further comprises edging at least one of the side edges of the third stretch film.

In an embodiment, the second support member comprises at least one height adjustment device to adjust the given height of the edged second stretch film along the first width of the first stretch film.

In an embodiment, edging at least one of the two opposite side edges of the second stretch film is performed using at least one of a guide, a roller and a pulley.

In an embodiment, edging at least one of the upper lateral side edge and a lower lateral side edge of the second stretch film comprises curling or bunching the at least one of the upper lateral side edge and a lower lateral side edge of the second stretch film.

In an embodiment, passing the partially overlapped films through a pre-stretcher comprises pre-stretching the combined stretch film under at least two different tensions along a height of the palletized load.

In accordance with another aspect, there is provided a method for securing a palletized load. The method comprises the steps of: dispensing a first stretch film comprising a first upper lateral side edge and a first lower lateral side edge from a first stretch film roll vertically inserted over a first support member; dispensing a second stretch film comprising a second upper lateral side edge and a second lower lateral side edge from a second stretch film roll vertically inserted over a second support member; partially overlapping the second stretch film and the first stretch film, comprising positioning the second upper end of the second stretch film at a given height relative to the first upper lateral side edge to form a combined stretch film having a double-ply film band substantially in a middle section of the combined stretch film; passing the partially overlapped films through a pre-stretcher; and wrapping the combined stretch film around the palletized load.

In an embodiment, the method further comprises dispensing a third stretch film comprising two opposite lateral side edges from a third stretch film roll vertically inserted over the second support member or over a third support member, comprising positioning the third stretch film at a given height along the first width of the first stretch film.

In an embodiment, at least one of the first stretch film and the second stretch film is inserted over an angled support member to rope the at least one of the first stretch film and the second stretch film.

In an embodiment, the method further comprises the step of: edging at least one of the lower and upper lateral side edges of the second stretch film to obtain an edged second stretch film.

In an embodiment, the at least one of the lower and upper lateral side edges of the second stretch film is the lower lateral side edge.

In an embodiment, both the lower and upper lateral side edges of the second stretch film are edged.

In accordance with another aspect, there is provided a method for securing a palletized load. The method comprises the steps of: dispensing a first stretch film comprising a first width, an upper lateral side edge and a lower lateral side edge opposite from the upper lateral side edge from a first stretch film roll vertically inserted over a first support member; dispensing a second stretch film comprising a second width and a second upper lateral side edge from a second stretch film roll vertically inserted over a second support member, the second width being larger than the first width; forming a first rope and a second rope with the second stretch film; partially overlapping the first rope over the first stretch film, comprising positioning the first rope over the upper lateral side edge of the first stretch film; partially overlapping the second rope over the first stretch film, comprising positioning the second rope over the lower lateral side edge of the first stretch film; passing the partially overlapped films through a pre-stretcher; and wrapping the combined stretch film around the palletized load.

In an embodiment, forming the first rope and the second rope comprises cutting the second stretch film along a length thereof to obtain a first section and a second section, the first section being roped to form the first rope and the second section being roped to form the second rope.

In accordance with another aspect, there is provided a method for securing a palletized load. The method comprises the steps of: dispensing a first stretch film comprising a first lower lateral side edge from a first stretch film roll vertically inserted over a first support member; dispensing a second stretch film comprising a second upper lateral side edge from a second stretch film roll vertically inserted over a second support member, comprising partially overlapping the second stretch film over the first stretch film by positioning the second upper lateral side edge at a given height above the first lower lateral side edge to obtain a combined stretch film having a combined stretch film width to form a double-ply film band substantially in a middle section of the combined stretch film; dispensing a third stretch film having a third stretch film width from a third stretch film roll vertically inserted over a third support member; forming a rope with the third stretch film, the rope fully overlapping the double-ply film band; passing the partially overlapped films through a pre-stretcher; and wrapping the combined stretch film and the third stretch film simultaneously around the palletized load.

In an embodiment, the third stretch film width is wider than the combined stretch film width.

In accordance with another aspect, there is provided a method for securing a palletized load. The method comprises the steps of: dispensing a first stretch film and a second stretch film each comprising an upper lateral side edge and a lower lateral side edge opposite from the upper lateral side edge from a first stretch film roll and a second stretch film roll respectively, the first and the second stretch film rolls being vertically inserted over a first support member and the second stretch film being mounted above the first stretch film; dispensing a third stretch film from a third stretch film roll vertically inserted over a second support member, comprising positioning the third stretch film to partially overlap the first and the second stretch film to obtain a combined stretch film; edging the upper lateral side edge of the first stretch film and the lower lateral side edge of the second stretch film; passing the partially overlapped films through a pre-stretcher; and wrapping the combined stretch film around the palletized load.

In an embodiment, both the upper lateral side edge and the lower lateral side edge of the first stretch film and the second stretch film are edged.

In accordance with another aspect, there is provided a method for securing a palletized load. The method comprises the steps of: dispensing a first stretch film and a second stretch film each comprising an upper lateral side edge and a lower lateral side edge opposite from the upper lateral side edge from a first stretch film roll and a second stretch film roll respectively; edging at least one of the upper lateral side edge and the lower lateral side edge of the first stretch film to obtain a first edged stretch film having a first width; edging at least one of the upper lateral side edge and the lower lateral side edge of the second stretch film to obtain a second edged stretch film having a second width, the first width being different from the second width; dispensing a third stretch film, comprising fully overlapping the third stretch film with the first edged stretch film and the second edged stretch film stretch film to obtain a combined stretch film; passing the combined stretch film through a pre-stretcher; and wrapping the combined stretch film around the palletized load.

In accordance with another aspect, there is provided a method for securing a palletized load. The method comprises the steps of: dispensing a first stretch film having a first width, a first upper lateral side edge and a first lower lateral side edge from a first stretch film roll vertically inserted over a first support member; dispensing a second stretch film having a second width, a second upper lateral side edge and a second lower lateral side edge from a second stretch film roll vertically inserted over a second support member; partially overlapping the second stretch film and the first stretch film, comprising positioning the second upper end of the second stretch film at a given height relative to the first upper lateral side edge to form a combined stretch film; passing the combined stretch film through a pre-stretcher; and wrapping the combined stretch film around the palletized load.

In an embodiment, the method further comprises the step of: edging at least one of the second upper lateral side edge and the second lower lateral side edge of the second stretch film to obtain an edged second stretch film, the second width of the edged second stretch film being narrower than the first width of the first stretch film; wherein partially overlapping the second stretch film and the first stretch film comprises partially overlapping the edged second stretch film and the first stretch film, comprising positioning the edged second stretch film at the given height along the first width of the first stretch film to obtain the combined stretch film.

In an embodiment, both the second upper lateral side edge and the second lower lateral side edge of the second stretch film are edged.

In an embodiment, the method further comprises the step of: dispensing a third stretch film having a third lateral upper lateral side edge and a third lower lateral side edge from a third stretch film roll vertically inserted over the first support member or over a third support member; and partially overlapping the third stretch film and the second stretch film, comprising positioning the third stretch film at a given height along the first width of the first stretch film to form a triple-band ply.

In an embodiment, the method further comprises edging at least one of the third upper lateral side edge and the third lower lateral side edge of the third stretch film.

In an embodiment, both of the third upper lateral side edge and the third lower lateral side edge of the third stretch film are edged to form a rope, and the rope is positioned within a width of the combined stretch film.

In an embodiment, at least one of the first support member and the second support member comprises at least one height adjustment device to adjust the given height of the edged second stretch film along the first width of the first stretch film.

In an embodiment, edging the at least one of the second upper lateral side edge and the second lower lateral side edge of the second stretch film comprises using at least one of a guide, a roller and a pulley.

In an embodiment, edging the at least one of the upper lateral side edge and the lower lateral side edge of the second stretch film comprises curling or bunching the at least one of the upper lateral side edge and a lower lateral side edge of the second stretch film.

In an embodiment, passing the partially overlapped films through a pre-stretcher comprises pre-stretching the combined stretch film under at least two different tensions along a height of the palletized load.

In an embodiment, at least one of the first stretch film and the second stretch film is inserted over an angled support member to rope the at least one of the first stretch film and the second stretch film.

In accordance with another aspect, there is provided a method for securing a palletized load. The method comprises the steps of: dispensing a first stretch film having a first width, a first upper lateral side edge and a first lower lateral side edge from a first stretch film roll; dispensing a second stretch film having a second width and a second upper lateral side edge from a second stretch film roll, the second width being larger than the first width; cutting the second stretch film along a length thereof to obtain an upper section and a lower second section; partially overlapping the first stretch film and the second stretch film, comprising positioning the upper section over the first upper lateral side edge of the first stretch film, and positioning the lower section over the first lower lateral side edge of the first stretch film; passing the partially overlapped films through a pre-stretcher; and wrapping the combined stretch film around the palletized load.

In an embodiment, the method further comprises forming a first rope with the upper section of the first stretch film and a second rope with the lower section of the second stretch film.

In an embodiment, the first stretch film is inserted substantially vertically over a first support member and the second stretch film is inserted substantially vertically over a second support member.

In an embodiment, the first stretch film and the second stretch film are inserted over a same support member.

In an embodiment, forming the first rope or the second rope comprises using a roller having a least one rolling unit.

In accordance with another aspect, there is provided a method for securing a palletized load. The method comprises the steps of: dispensing a first stretch film having a first upper lateral side edge and a first lower lateral side edge from a first stretch film roll vertically inserted over a first support member; dispensing a second stretch film having a second upper lateral side edge and a second lower lateral side edge from a second stretch film roll vertically inserted over a second support member; partially overlapping the second stretch film and the first stretch film by positioning the second upper lateral side edge at a given height above the first lower lateral side edge to obtain a combined stretch film; dispensing a third stretch film having a third upper lateral side edge and a third lower lateral side edge from a second stretch film roll vertically inserted above the first stretch film roll inserted over the first support member, without the third stretch film overlapping with the first stretch film, thereby forming an upper double-ply band and a lower double-ply band; passing the partially overlapped films through a pre-stretcher; and wrapping the combined stretch film and the third stretch film simultaneously around the palletized load.

In an embodiment, the method further comprises edging at least one of the first upper lateral side edge and the third lower lateral side edge.

In an embodiment, the method further comprises forming a first rope with the first stretch film and a third rope with the third stretch film, wherein the second lower lateral side edge of the second stretch film is positioned within the first rope and the second upper lateral side edge of the second stretch film is positioned within the third rope.

In an embodiment, the method further comprises forming a second rope with the second stretch film, the second rope extending upwardly above the third lower lateral side edge and downwardly below the first lateral side edge.

DETAILED DESCRIPTION

Figure 1A:
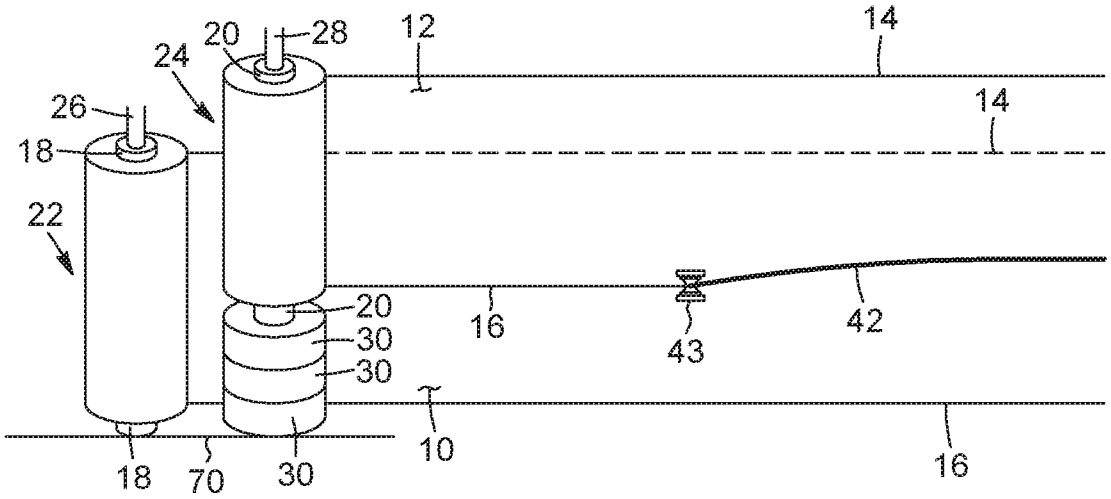
FIG. 1A is a schematic representation of a first stretch film and a second stretch film positioned according to an embodiment, wherein the second stretch film partially overlaps the first stretch film, and a lower lateral side edge of the second stretch film is edged.

In the following description, there are described various embodiments related to methods and apparatuses for securing products or goods palletized on a pallet, i.e., a palletized load, using different layering or overlapping configurations of at least two stretch films relative to one another. The stretch films can be dispensed from respective stretch film rolls and stretch wrapped around the palletized load.

The methods and apparatuses described herein can contribute to advantageously seal, stabilize and/or protect the palletized load, for instance during its storage and/or transport. In some scenarios, various overlapping, or layering, configurations of a plurality of stretch films, whether the stretch films are used as is, edged, or roped, are provided. The various layering configurations can be obtained using height adjustment devices to position a respective stretch film roll at a given height relative to another stretch film roll. The layering configurations can be such that a double-ply band alone or combined with a triple-ply band can be obtained. In some scenarios, the width of each rope fully overlapping a stretch film can vary along a height of the stretch film i.e., when the stretch film roll is positioned substantially vertically, and the width of the ropes can also vary within a stretch wrapping operation. The stretch film can be edged or roped using different techniques, which can result in the lateral side(s) of the stretch film being curled up or bunched up, thus providing distinct properties to the edged or roped stretch film. The stretch film can also be stretch wrapped using a first tension for a first stretch film and a second tension, different from the first one, for the second stretch film, or the tension of a combined stretch film can vary along the height of the palletized load.

As used herein, a palletized load refers to products or goods packed on a pallet according to methods known in the art, for example to store the products or goods and/or for subsequent transport of the pallet from one place to another. To ensure that the integrity of the products or goods is maintained once they are palletized as a palletized load on a pallet and when the pallet is stored or moved, the palletized load is stretch wrapped with stretch film. It is to be noted that the expression "stretch film" is interchangeable with the expressions "stretch wrap", "stretching film", "stretch film" and "wrapping film".

As used herein, a stretch film refers to a thin film of plastic such as cellophane, that is commonly made of linear low-density polyethylene (LLDPE), and that is stretchable to various extents. Stretch film can be manufactured using extrusion processes, for example a cast extrusion process, or can be manufactured using a blown process. Stretch film is commonly used to wrap items, since following stretching of the stretch film, which can be performed using different techniques, the elastic recovery of the stretch film can keep the items tightly bound together. The yield strength of the stretch film refers to the extent of stretching that the stretch film can sustain without permanently deforming.

The stretch film can have various characteristics such as different thicknesses, widths, and compositions. A film thickness can be expressed in gauges, and the thickness of the stretch film is correlated with the extent of stretching that the film can sustain.

Having discussed the general context related to the methods and apparatuses for securing a palletized load on a pallet using stretch film, optional embodiments will be discussed further hereinbelow. The embodiments according to the following description are given for exemplification purposes only.

Method Implementations

In the method implementations described below, one of the two stretch films is referred to as a first stretch film 10, and the other is referred to as a second stretch film 12. It is to be understood that these designations are for illustrative purposes only, and are interchangeable depending on the context. Each one of the stretch films 10, 12 is characterized by a width, and includes an upper lateral side edge 14 and a lower lateral side edge 16, the upper lateral side edge 14 being opposite to the lower lateral side edge 16. It will be appreciated that, in the present description, positional descriptions such as "upper", "lower" and the like should be taken in the context of the figures only and should not be considered limiting. In particular, when referring to lower and upper features, it is intended to mean with respect to the relative position of the given feature when a stretch film roll is positioned vertically or at an obtuse or acute angle relative to an horizontal axis. When referring to a "lateral" feature, it is intended to refer to a feature extending along an horizontal axis. When referring to a height, for instance in the context of a height of a stretch film when the stretch film is inserted vertically over a bar of a stretch film support member, it is to be understood that it refers to a measure along a substantially vertical axis extending upwardly from the base of a stretch film carriage.

The stretch films can have different widths. For example, stretch films having a width ranging from 5" to 30" can be used. For instance, in some implementations, stretch films having a width of 15", 18", 20" or 30" can be used, which are stretch film widths that are commonly used to wrap a palletized load using an automatic stretch wrapping machine as known in the art. It is to be understood that when two or three stretch film rolls are used in combination, their respective widths can be identical or they can be different. For instance, a stretch film having a width of 30" can be combined with a stretch film having a width of 15", or two stretch film having a width of 20" can be used in combination. Thus, any combinations of widths of stretch film is within the scope of the present description.

Partial Overlapping

Two Rolls of Stretch Film

In the implementations shown in FIGS. 1A, 1B, 4 and 7, the first stretch film 10 and the second stretch film 12 are rolled around a first spool 18 and a second spool 20, respectively. The combination of the first stretch film 10 and the first spool 18 forms a first stretch film roll 22. Similarly, the combination of the second stretch film 12 and the second spool 20 forms a second stretch film roll 24. Each one of the first and second stretch films rolls 22, 24 is inserted over a respective support member 26, 28. The support member 26, 28 can be for instance a bar extending upwardly from an horizontal platform of a stretch film carriage. For example, the support member 26, 28 can extend from the horizontal platform of the stretch film carriage at an angle of about 90°. The internal diameter of the spool 18, 20 is such that when the stretch film roll 22, 24 is inserted over the support member 26, 28, the spool 18, 20 is allowed to rotate freely about the bar to dispense the stretch film linearly from the spool 18, 20. This vertical positioning of the stretch film rolls 22, 24 over their respective support member 26, 28 can facilitate the unwinding of the stretch film 10, 12 from the spool 18, 20, and minimize the manipulation of the stretch film prior to the stretch film being wrapped around the palletized load. It is to be understood that in other implementations, the support member 26, 28 can also extend upwardly from the horizontal platform of the machine at different angles than 90°, as will be explained in further detail below. It is also to be understood that other types of support members can be used to support a stretch film roll as described herein, which can be chosen for instance depending on the application.

Figure 4:
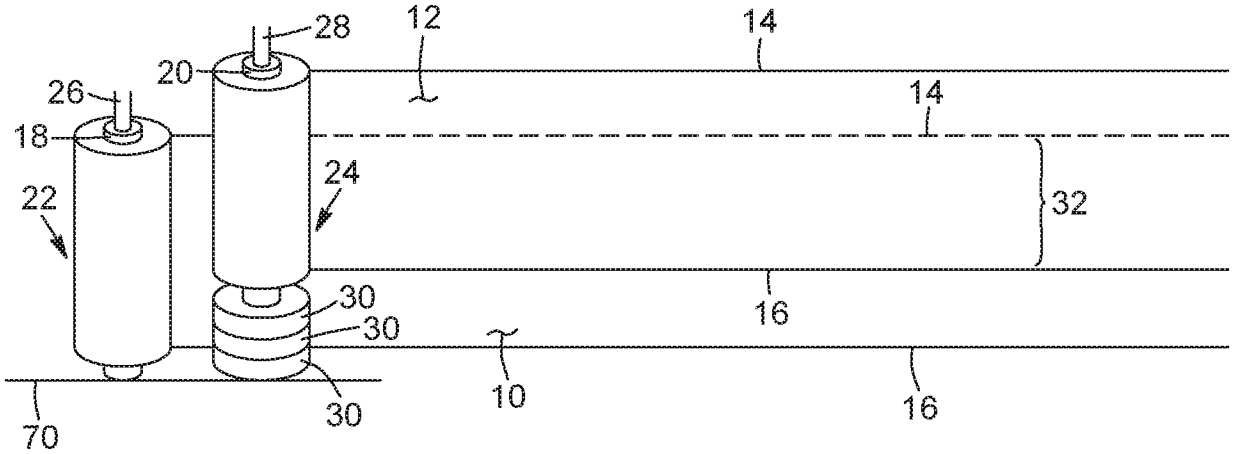
FIG. 4 is a schematic representation of a first stretch film and a second stretch film positioned according to another embodiment, wherein the second stretch film partially overlaps the first stretch film.

Referring to FIG. 4, the second stretch film roll 24 is positioned at a given height relative to the first stretch film roll 22 and thus at a given distance from the horizontal platform of the stretch film carriage such that when the first stretch film 10 and the second stretch film 12 are linearly unrolled from their respective spool 18, 20, they partially overlap each other and form a combined stretch film. In order to obtain this overlapping configuration, the spool 20 of the second stretch film roll 24 is supported by two height adjustment devices 30 positioned underneath the spool 20. This feature will be discussed in further detail below. By partially overlapping, the first stretch film 10 and the second stretch film 12 are offset from one another and form a double-ply band 32 of a given width in a middle section of the combined film. For example, in some implementations, the first stretch film and the second stretch film can each have a width of about 20", and once they are positioned to partially overlap and to form the combined stretch film, the overall width of the combined film can be for instance between about 21" and about 39". By overlapping the first stretch film 10 and the second stretch film 12 to obtain the double-ply band 32, the overall resistance of the combined stretch film can be increased, in particular in the region of the double-ply band 32, which can contribute to prevent a tear that started in the first stretch film 10 or in the second stretch film 12 from propagating along the entire width of the stretch film once it reaches the double-ply band 32.

Three Rolls of Stretch Film

Figure 5:
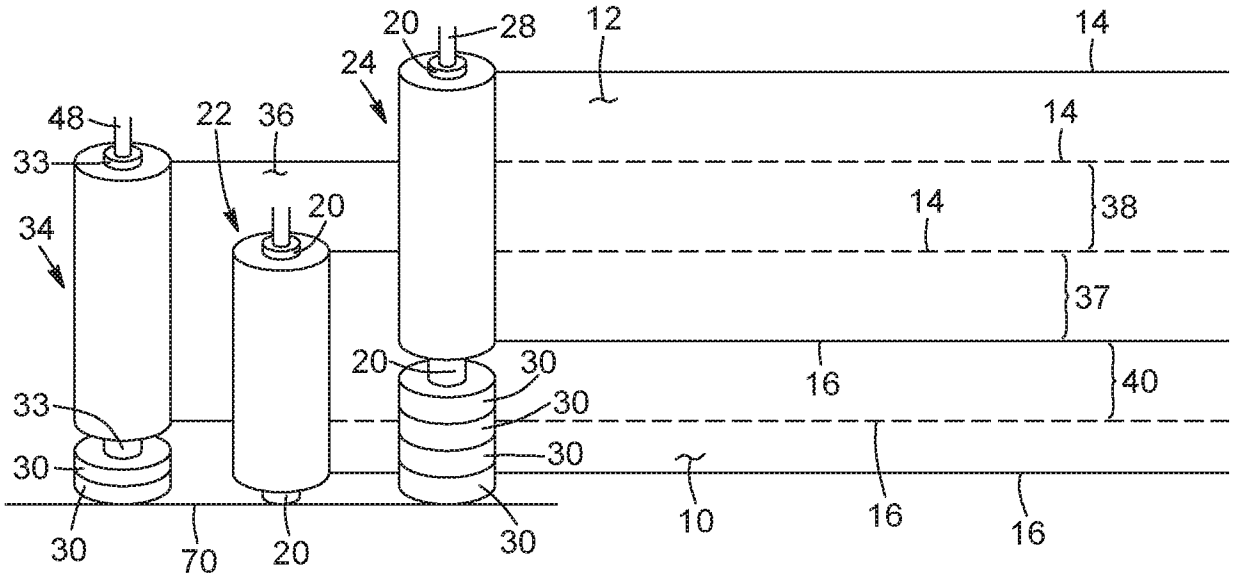
FIG. 5 is a schematic representation of a first stretch film, a second stretch film and a third stretch film positioned according to an embodiment, wherein the second stretch film partially overlaps the first stretch film, a double-ply band is formed, a triple-ply band is formed and overlaps the double-ply band.

In some implementations, three rolls of stretch film can be used. With reference to FIG. 5, the first stretch film roll 22 and the second stretch film roll 24 are positioned and overlapping similarly to the embodiment illustrated in FIG. 4, with the exception that an additional height adjustment device 30 is placed underneath the spool 20 of the second stretch film roll 24. A third stretch film roll 34 is added and positioned at a given height relative to the first and second stretch film rolls 22, 24 using a given number of height adjustment devices 30 such that a third stretch film 36 fully overlaps the double-ply band 32 formed by the first stretch film 10 and the second stretch film 12. The number of height adjustment devices is chosen to obtain the desired position of each one of the three stretch films 22, 24, 34 relative to one another. This configuration allows to obtain a triple-ply band 37 in a middle section of the double-ply band 32, and also forms an upper double-ply band 38 above the triple-ply band 37 and a lower double-ply band 40 below the triple-ply band 37. In this configuration, the combined stretch film can have an increased resistance given the presence of areas having a double or a triple thickness of stretch film at specific locations throughout the width of the combined stretch film.

Figure 3:
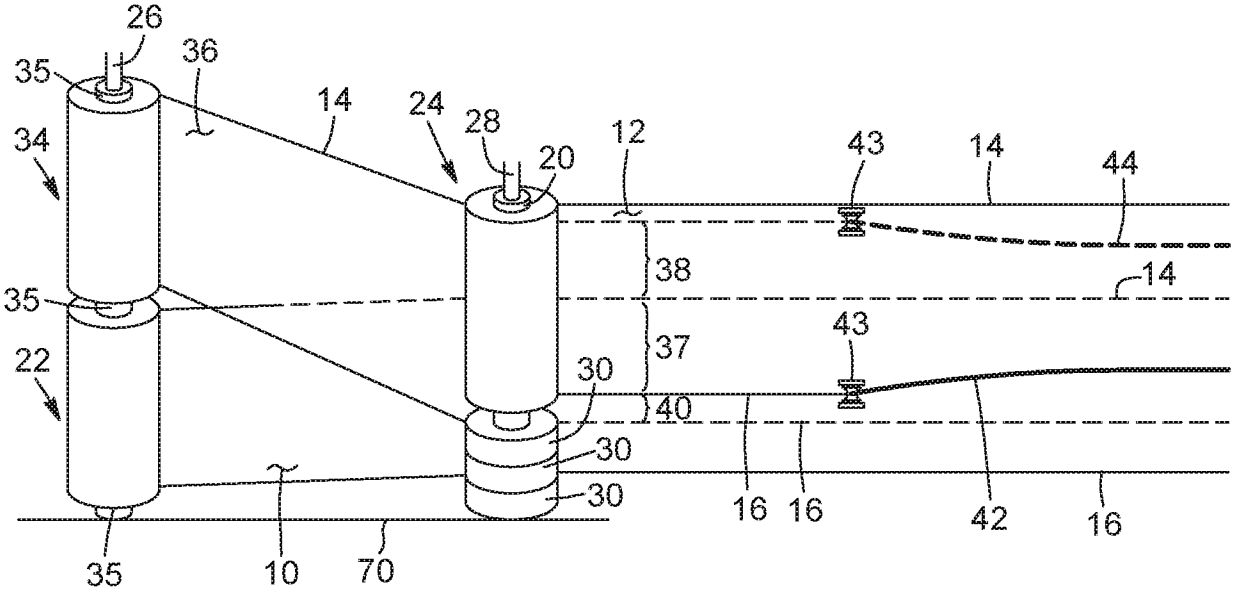
FIG. 3 is a schematic representation of a first stretch film, a second stretch film and a third stretch film positioned according to an embodiment, wherein the second stretch film partially overlaps the first stretch film and a lower lateral side edge of the second stretch film and an upper lateral side edge of the third stretch film are edged.

In other implementations and as shown in FIGS. 3, 6A, 6B and 10, two of the three stretch film rolls, i.e. the first stretch film roll 22 and the third stretch film roll 34, are inserted over a single support member 26, the third stretch film roll 34 being positioned above the first stretch film roll 22. In FIG. 3, the configuration of the two stretch film rolls 22, 34 may require a redirecting of the first stretch film 10 and/or of the third stretch film 36 to obtain desirable overlapping configurations of the two stretch films 10, 36, as will be explained in more detail below. The positioning of the first stretch film rolls 22, 24, 34 relative to one another is determined according to the desired overlapping configuration of the desired resulting combined stretch film. This positioning can be obtained using various types and number of height adjustment devices 30. In some implementations, the first stretch film 10 and the third stretch film roll 36 are wound up around a single spool 35 (see for instance FIGS. 3, 6A, 6B, 10, 11 and 13). In other implementations, the first stretch film 10 and the third stretch film are wound up around respective spools.

It is to be noted that in some implementations, and for instance referring to FIGS. 3, 6A, 6B and 10, the first stretch film roll 22 and the third stretch film roll 34 can be replaced by a single stretch film roll that is cut in a middle section thereof, in order to obtain two sections: an upper section and a lower section, the upper and lower sections allowing to obtain the desired combined film. There can also be multiple rolls on a same unitary spool, and one or more of the rolls can be cut to form sections (e.g., two rolls on a single spool can each be cut in a middle region thereof to form four sections that are used in a certain wrapping pattern to wrap the palletized load), as will be detailed below.

Two Stretch Films on a Single Spool and Cutting

In implementations where a first stretch film and a second stretch film are provided on a single spool, one or both of the first stretch film and the second stretch film can be cut into a given number of sections to obtain a corresponding number of single ply bands. The number of single ply bands can range from two to any number that allows the width of the single ply band to remain sufficiently resistant to tearing once wrapped around a palletized load. For instance, in some implementations, up to six single ply bands can be obtained from a stretch film. The given number of single ply bands can also vary depending of the width of the stretch film, i.e., the wider the stretch film, the higher the number of single ply bands that can be obtained from cutting. In some implementations, at least one of the single ply bands that is obtained can have one of its lateral side edges edged or can be roped. In some implementations, only one of the first stretch film and the second stretch film provided on a single spool is cut into a given number of single ply bands, the other one of the first stretch film and the second stretch film retain its original width.

Figure 13:
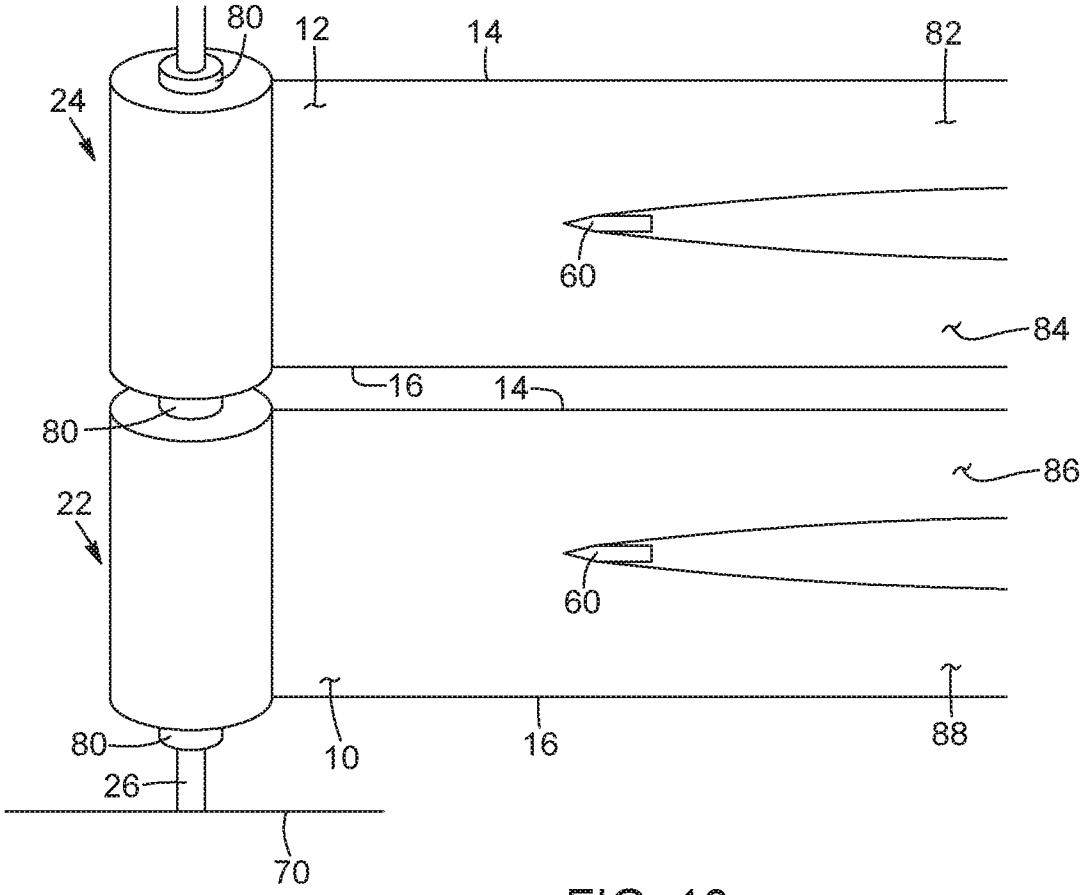
FIG. 13 is a schematic representation of a first stretch film roll and a second stretch film roll positioned according to an embodiment, wherein the first stretch film roll and the second stretch film roll are provided on a same spool, and wherein each one of the first stretch film and the second stretch film is cut in a middle section thereof to form a respective upper section and lower section.

With reference to FIG. 13, the first stretch film 10 and the second stretch film 12 are provided on a single spool 80. The first stretch film 10 is shown cut into a first upper band 82 and a first lower band 84, and the second stretch film 12 is shown cut into a second upper band 86 and a second lower band 88. In the embodiment shown, the first upper band 82, the first lower band 84, the second upper band 86, and the second lower band 88 have retained their full width.

Edged or Roped Stretch Film

In some implementations, at least one of the first and second stretch films 10, 12 that is intended to be stretch wrapped around the palletized load in a multi-layer configuration is roped or edged, which can further improve the resistance of the stretch film to tearing, reduce the susceptibility of the stretch film to puncture, and reduces the risk for a small tear to propagate throughout the entire palletized load. As used herein, the term "roped" refers to a stretch film having a reduced width compared to its original width and having both upper and lower lateral side edges bunched, as will be described in further detail hereinbelow. A rope can also be referred to as a cord, as it is known in the art. As used herein, the term "edged" refers to a stretch film having one of its side edges bunched up, also to narrow the width of the stretch film but to a lesser extent than for the roped stretch film. Accordingly, a stretch film having both of its upper and lower lateral side edges edged would be considered a rope. In the Figures, an edged rope is shown as a bold line, in comparison with a non-edged lateral side edge which is shown as a regular line.

The edging of a lateral side edge of the stretch film can be performed according to methods known in the art, for instance using a roller or a pulley, rotating in the same direction as the unwinding of the stretch film, to bunch up the lateral edge of the stretch film by directing the lateral edge of the stretch film towards a center line of the stretch film extending along a length thereof. In the illustrated embodiments, a pulley 43 is shown to bunch up a lateral side of the stretch film. The roller or a pulley is positioned at a given height from the lower lateral side edge of the stretch film to obtain the desired width of the resulting edged stretch film. With regard to roping, a ring can also be used to bunch up the stretch film along both lateral side edges. In this implementation, the stretch film is passed through the ring having a given internal diameter chosen according to the desired width of the roped stretch film. A guide or a pair of guides can also be used to edge or rope the stretch film, respectively. The guide can be an outwardly extending member extending substantially perpendicularly from a guide support, the guide support extending upwardly from the base of the stretch film carriage. It is to be understood that various configurations of the guide and guide support are possible. The guide restricts the passage of the stretch film to a particular width by guiding the stretch film inwardly towards a center line of the stretch film extending along a length thereof. When a pair of guides is used, the two guides are placed at a given distance from one another which corresponds to the resulting width of the roped stretch film.

Figure 1B:
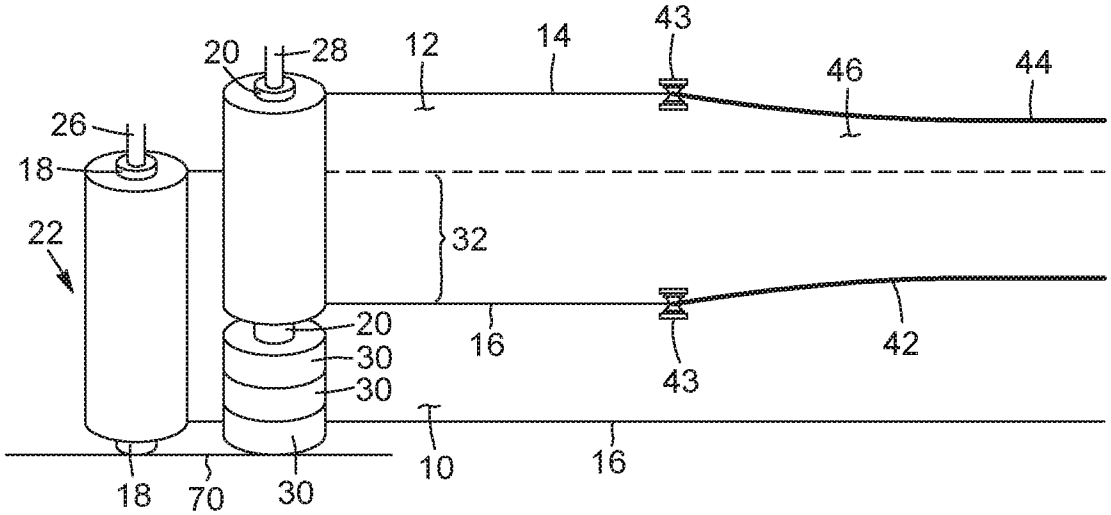
FIG. 1B is a schematic representation of a first stretch film and a second stretch film positioned according to an embodiment, wherein the second stretch film partially overlaps the first stretch film, and a lower lateral side edge and an upper lateral side edge of the second stretch film are edged.

With reference to FIGS. 1A and 1B, the lower lateral side edge 16 of the second stretch film 12 is edged to form an edged lower lateral side edge 42. The edging of the lower lateral side edge 16 of the second stretch film 12 typically reduces the width of the second stretch film 12, but reduces it such that the edged lower lateral side edge 42 remains within the original width of the double-ply band 32. By edging the lower lateral side edge 16 of the second stretch film 12, the resistance of the double-ply band 32 can be further increased relative to when only the double-ply band is present. In these implementations, the width of the combined stretch film is narrower compared to the width of the combined stretch film in implementations in which the lower lateral side edge 16 of the second stretch film 12 is not edged. It is important to note that even when the lower lateral side edge 16 of the second stretch film 12 is edged, the narrowed width of the second stretch film 12 still partially overlaps the first stretch film 10, i.e. the second stretch film 12 is offset relative to the first stretch film 10.

Referring to FIG. 1B, in some implementations, both the upper lateral side edge 14 and the lower lateral side edge 16 of the second stretch film 12 are edged and thus the edged lower lateral side edge and an edged upper lateral side edge 44 of the second stretch film 12 forms a rope 46. In this configuration, the resulting width of the secondary stretch film 12, i.e., of the rope 46, is narrower than the width of the secondary stretch film 12 when only the lower lateral side edge 16 of the second stretch film 12 is edged. However, the width of the rope 46 remains sufficiently wide to partially overlaps the first stretch film 10. The rope 46 can be formed using two guides positioned at a given distance from each other. The rope can also be formed by passing the stretch film through an annular device, thereby forcing the stretch film to adopt a width similar to an inside diameter of the annular device.

It is to be understood that implementations mirroring the implementations described above are also within the scope of the present description. For instance, the first stretch film roll 22 can be positioned higher than the secondary stretch film roll 24. In that case, the upper lateral side edge 14 of the second stretch film 12 is edged and is positioned below the upper lateral side edge 14 of the first stretch film 10. The overlapping of the first and the second stretch films 10, 12 forms a double-ply band between the upper lateral side edge 14 of the second stretch film 12 and the lower lateral side edge 16 of the first stretch film 10. The upper lateral side edge 14 of the second stretch film 12 can be edged while still remaining within the width of the first stretch film 10, i.e., while still overlapping the first stretch film 10.

Similarly to the partial overlapping configuration of the first and second stretch films illustrated in FIG. 4, the partial overlapping configurations shown in FIGS. 1A and 1B with one or both lateral side edges of the second stretch film being edged, can provide a combined stretch film having an increased resistance to tear in the doubly ply region, while offering a higher coverage compared to a configuration where the first and the second stretch films would be fully overlapping.

Figure 6A:
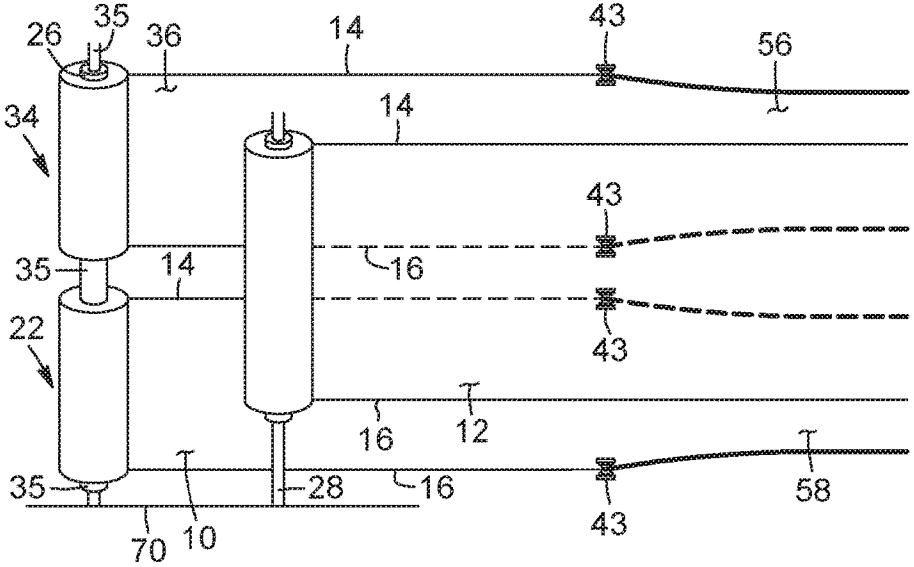
FIG. 6A is a schematic representation of a first stretch film, a second stretch film and a third stretch film positioned according to an embodiment, wherein the second stretch film partially overlaps the first stretch film, the third stretch film partially overlaps the first stretch film, and the second stretch film and the third stretch film are roped.
Figure 6B:
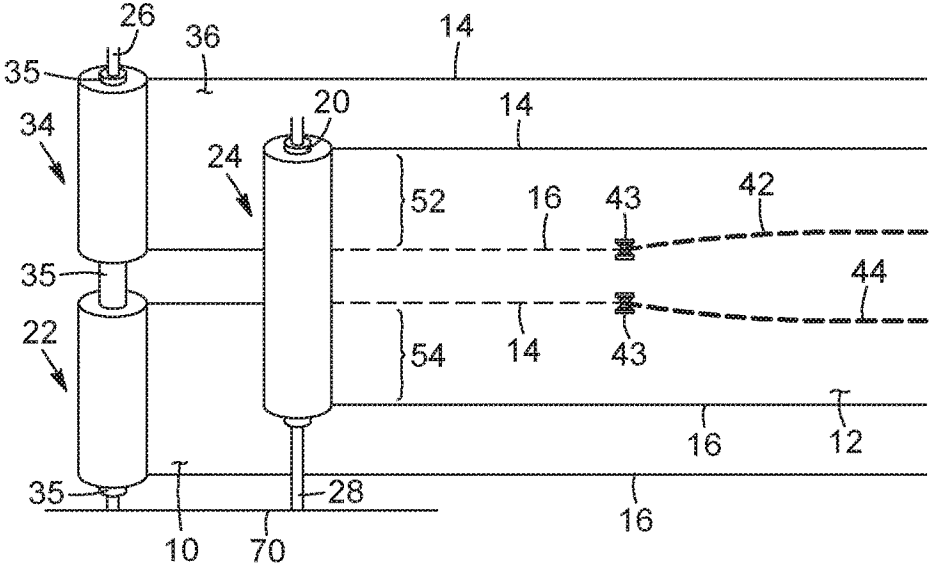
FIG. 6B is a schematic representation of a first stretch film, a second stretch film and a third stretch film positioned according to an embodiment, wherein the second stretch film partially overlaps the first stretch film, the third stretch film partially overlaps the first stretch film, and an upper lateral side edge of the second stretch film and a lower lateral side edge of the third stretch film are edged.

Referring to FIGS. 6A and 6B, three stretch film rolls 22, 24, 34 are provided. In the illustrated embodiment, the first and the third stretch film rolls 22, 34 are inserted vertically over the same support member 26, the third stretch film roll 34 being positioned above the first stretch film roll 22. The third stretch film roll 34 is placed at a given distance from the first stretch film roll 22, the given distance being chosen such that when the third stretch film 36 is unwound from the spool 35, the third stretch film 36 partially overlaps the second stretch film 12 in an upper section thereof and the first stretch film 10 partially overlaps the second stretch film 12 in a lower section thereof. This configuration forms two double-ply bands, i.e., an upper double-ply band 52 and a lower double-ply band 54. FIG. 6A shows an embodiment in which the first stretch film 10 is roped and partially overlaps the second stretch film 12, and the third stretch film 36 is roped 56 and also partially overlaps the second stretch film 12. Thus, in contrast with the embodiment shown in FIG. 3, the first stretch film 10 and the third stretch film 36 do not overlap.

FIG. 6B is similar to FIG. 6A, with the exception that only one of the lateral side edges of each one of the first stretch film 10 and the third stretch film 36 is edged.

Figure 7:
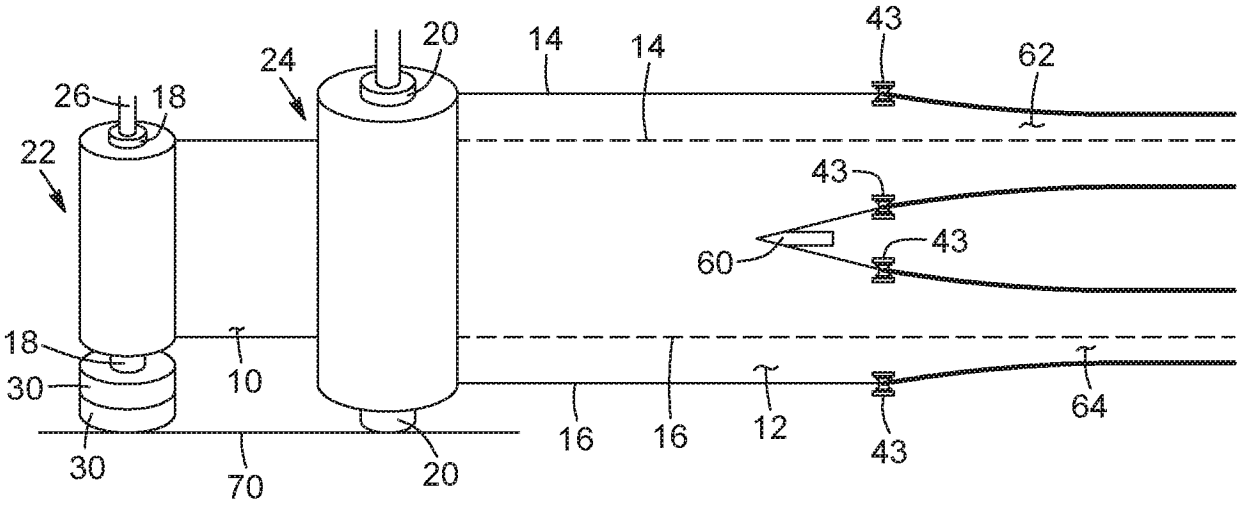
FIG. 7 is a schematic representation of a first stretch film and a second stretch film positioned according to an embodiment, wherein the second stretch film is cut in a middle section thereof to form an upper section and a lower section, the upper section partially overlapping the first stretch film, the lower section partially overlapping the first stretch film, and the upper section and the lower section are roped.

FIG. 7 shows an embodiment that includes a first stretch film roll 22 and a second stretch film roll 24, the width of the second stretch film 12 being wider than the width of the first stretch film 10. In this embodiment, a cutting tool 60, such as a knife, is provided to cut the second stretch film 12 in a middle section thereof, in order to obtain two sections: an upper section and a lower section. The upper section and the lower section are roped to form an upper rope 62 and a lower rope 64, respectively. As with the embodiment shown in FIG. 6A, the upper rope 62 partially overlaps the first stretch film 10 in the upper section thereof, and the lower rope 64 partially overlaps the first stretch film 10 in the lower section thereof.

Figure 9:
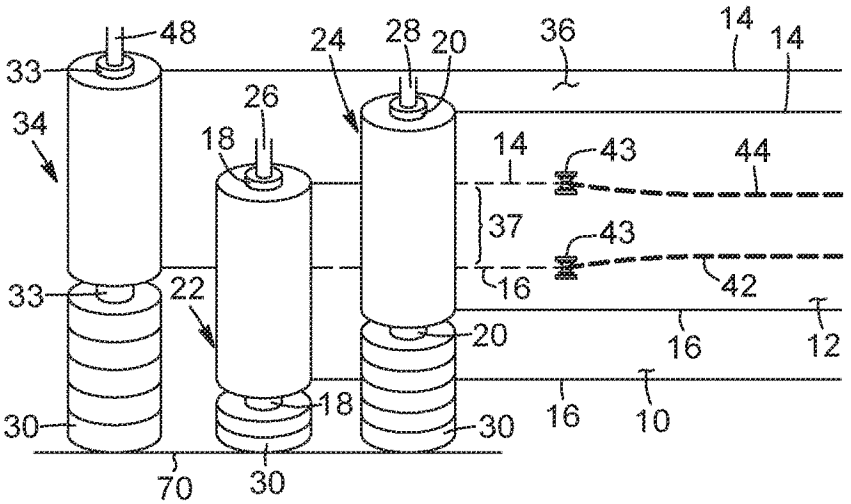
FIG. 9 is a schematic representation of a first stretch film, a second stretch film and a third stretch film positioned according to an embodiment, wherein the upper lateral side edge of the first stretch film is edged and the lower lateral side edge of the third stretch film is edged.

FIG. 9 shows an embodiment that includes a first stretch film roll 22, a second stretch film roll 24, and a third stretch roll 34. The upper lateral edge 14 of the first stretch film 10 is edged 44 and the lower lateral edge 16 of the third stretch film 36 is also edged 42. A triple-ply band 37 is formed by this overlapping configuration.

Figure 10:
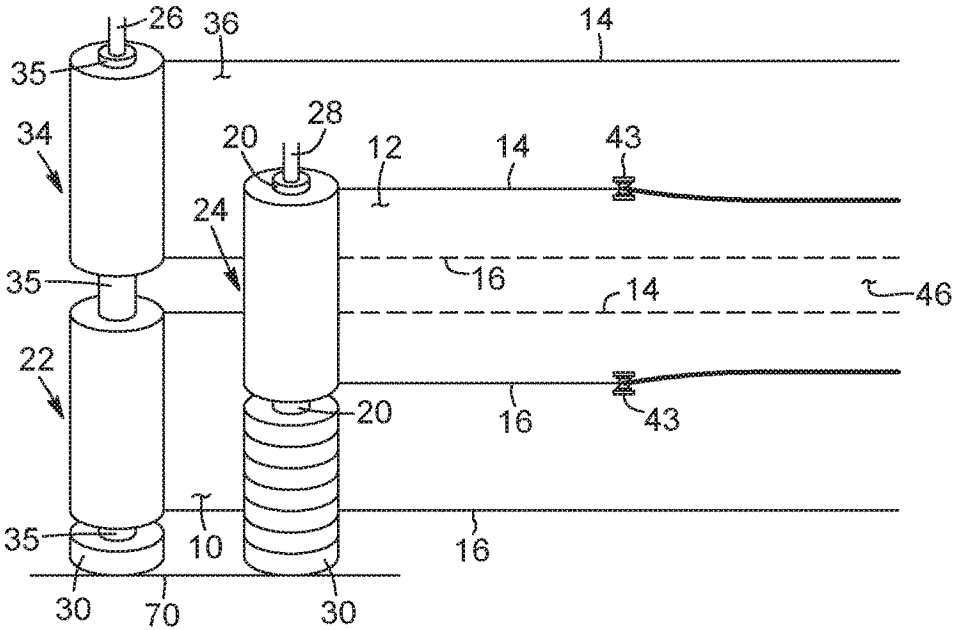
FIG. 10 is a schematic representation of a first stretch film, a second stretch film and a third stretch film positioned according to an embodiment, wherein the second stretch film is roped.

With reference to FIG. 10, the first, second and third stretch films 10, 12, 36 are positioned to overlap in a similar fashion as the embodiment shown in FIG. 6B. However, instead of the lower lateral side edge 16 of the third stretch film 36 being edged 42 and the upper lateral side edge 14 of the first stretch film 10 being edged 44, the second stretch film 12 is roped 46 and partially overlaps the first stretch film 10 in an upper section thereof and the third stretch film 36 in a lower section thereof.

In all of the implementations described above, the width of the double-ply band, the width of the triple-ply band, the width of the section between a lateral side edge and an edged lateral side edge, and the width of the ropes can be varied according to the stretch wrapping needs, which can depend for instance of the characteristics of the palletized load. An important feature of the implementations described above is the extent of overlapping of a given stretch film relative to another stretch film.

It is to be understood that the embodiment shown in the figures are for illustrative purposes only and are not to scale. Features such as the distance between the stretch film rolls when they are mounted one above the other on a single support member, the height of the stretch film rolls with respect to the base of the stretch film carriage frame, and the extent of overlapping shown in the figures are examples only. The position of the stretch films relative to one another when they are overlapping can vary, as long as they are either partially overlapping or fully overlapping when this feature is specifically mentioned.

Height Adjustments with Spacers

As mentioned above, the stretch film rolls described herein can be placed at a given distance from the base of the stretch film carriage frame, which can allow to obtain a given overlapping configuration of the stretch films once they are unwound from their respective spool. In some implementations, the distance of the stretch film roll from the base of the stretch film carriage frame can be adjusted by placing a given number of height adjustment devices underneath the stretch film roll such that the spool can rest on an upper surface of the highest height adjustment device.

The height adjustment devices can be any types of puck, block or spacer that can be placed underneath the spool and that is configured to not interfere with the unrolling of the stretch film from the stretch film spool. The thickness of each height adjustment device can vary depending on the user's needs and can range for instance from 1" to 6". There may be a set of height adjustment devices (e.g., pucks) that have different thicknesses (e.g., 0.25", 0.5", 1", 2", 3", 4", 6", 8" etc.) that can be combined together to make different overall heights (e.g., a 5.75" overall height can be provided by stacking pucks of 0.25", 0.5", 2" and 3" together). The outer perimeter of the puck can also have various shapes. For instance, the height adjustment device can be an annular-shaped puck, i.e., a donut-shaped puck, that is inserted over the bar of the stretch film carriage frame. The desired number of height adjustment devices to position the stretch film roll at the given distance from the stretch film carriage frame can be inserted over the bar of the stretch film carriage manually by a user prior to the stretch film roll being inserted over the bar.

The height adjustment devices can also be C-shaped to allow their insertion around the bar by lateral translation, either before the stretch film roll is inserted over the bar, or after the stretch film roll is inserted over the bar which can involve lifting the stretch film roll at a height higher than the thickness of the height adjustment device(s) and sliding the height adjustment device underneath the stretch film roll. The C-shaped height adjustment device can include a closure element in a portion thereof, such as a mechanical opening gate, that can close the opening following placement around the bar and to form a donut that encircles the bar.

In some implementations, the stretch film roll can be positioned at a given distance from the base of the stretch film carriage frame using an automatic height adjustment assembly that can translate upwardly and downwardly to vary the height of the stretch film roll. For instance, the automatic height adjustment assembly can include a support structure located underneath the stretch film roll when the stretch film roll is inserted over a support member, the support structure having an upper surface onto which the lower end of the spool of the stretch film roll can be abutted. In some implementations, the height of the support structure is modifiable through the action of a device such as a piston operatively connected to a controller. It is to be understood that other types of devices or mechanisms can be suitable to vary the height of the stretch film roll and are within the scope of the present description. The height adjustment mechanism can be configured to enable positioning at predetermined height increments (e.g., using combinations of pucks having different thicknesses) or at any point by using a device that enables positioning at any location using, for example, an actuated piston, stepper motors, or other mechanisms that facilitate precise positioning.

Angled Stretch Film Rolls

In some implementations, at least one of the two stretch film rolls is positioned at an angle relative to the base of the carriage frame, instead of being positioned vertically and substantially parallel to another stretch film roll. Angling at least one of the stretch film rolls can allow the formation of a rope as the stretch film is being unwound from the spool because of the orientation change of the stretch film, i.e. the stretch film unwinds parallelly to the base of the stretch film carriage frame from the spool, instead of unwinding perpendicularly to the spool.

Figure 12:
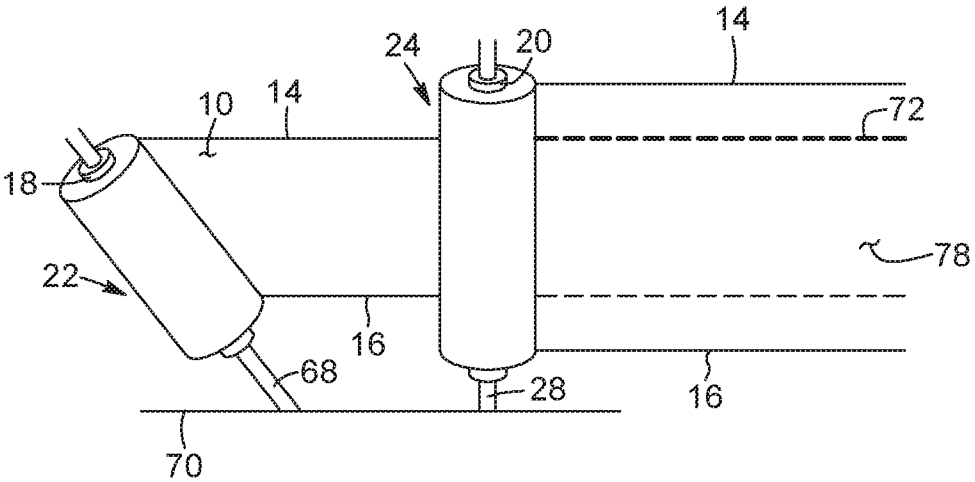
FIG. 12 is a schematic representation of a first stretch film and a second stretch film positioned according to an embodiment, wherein the first stretch film is roped and dispensed from a first stretch film roll that is angled with respect to a base of a stretch film carriage.

With reference to FIG. 12, the support member 68 of the first stretch film roll 22 extends upwardly from the base 70 of the carriage frame at an obtuse angle of approximately 130°, in contrast with the support member 28 of the second stretch film roll 24 that extends upwardly at a normal angle from the base 70 of the stretch film carriage frame. The first stretch film 10 is unwound from the spool 18 to form an edged upper lateral side edge 72. The resulting edged stretch film 78 fully overlaps the second stretch film 12. In some implementations, the angle of the first stretch film roll 22 relative to the base of the carriage can be determined taking into consideration the resulting tension of the lower lateral side edge following unwinding of the stretch film 10 therefrom. Indeed, the more obtuse the angle of the first stretch film 22 relative to the base 70 of the carriage frame is, the looser the lower lateral side edge 16 will be, and the tighter the upper lateral side edge 14 will be.

Stretch Film with a Triple-Ply Band

In some implementations, the overlapping configuration of three stretch films can result in the formation of one triple-ply band and at least one double-ply band.

Referring back to FIG. 5, a first stretch film 10, a second stretch film 12 and a third stretch film 36 are overlapping such that a first double-ply band 38 is formed by the overlapping of the second stretch film 12 and the third stretch film 36, and a second double-ply band 40 is formed by the overlapping of the first stretch film 10 and the second stretch film 12. A triple-ply band 37 is formed in a middle section of the combined stretch film.

Figure 2:
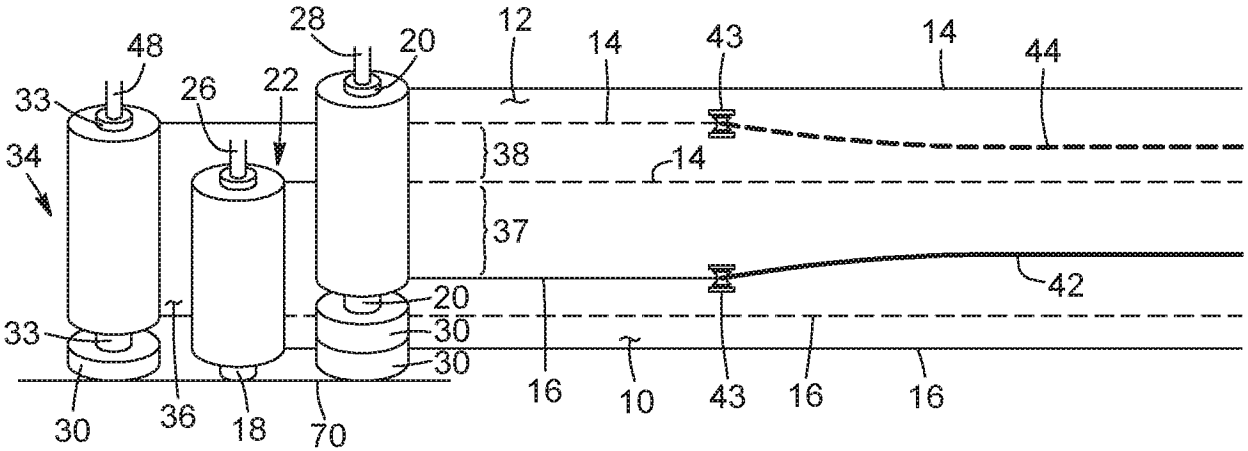
FIG. 2 is a schematic representation of a first stretch film, a second stretch film and a third stretch film positioned according to an embodiment, wherein the second stretch film partially overlaps the first stretch film, and a lower lateral side edge of the second stretch film and an upper lateral side edge of the third stretch film are edged.

With reference to FIGS. 2 and 3, there are shown two embodiments having similar characteristics to those of the embodiment shown in FIG. 1A, in which two stretch film rolls 22, 24 are provided and the lower lateral side edge 16 of the second stretch film 12 is edged to form the edged lower lateral side edge 42. In the embodiment shown in FIG. 2, a third stretch film roll 34 is provided and positioned such that the third stretch film 36 fully overlaps the double-ply band formed by the first and the second stretch films 10, 12. The third spool 33 is inserted over a third support member, or bar 48. In this embodiment, the lower lateral side edge 16 of the second stretch film 12 is edged 42 and remains within the width of the double-ply band that would be formed if only the first and second stretch film rolls 22, 24 were provided. The upper lateral side edge 14 of the third stretch film 36 is also edged 44. The overlapping configuration of the three stretch films 10, 12, 36 shown in FIG. 2 is thus similar to the overlapping configuration shown in FIG. 5, with the difference that the lower lateral side edge 16 of the second stretch film 12 and the upper lateral side edge 14 of the third stretch film 36 are edged 42, 44.

In the embodiment shown in FIG. 3, the resulting overall configuration of the three stretch films 10, 12, 36 is identical to the overall configuration of the three stretch films 10, 12, 36 shown in FIG. 2, but the first and the third stretch film rolls 22, 34 are inserted vertically on the same support member 26, the third stretch film roll 34 being positioned above the second stretch film roll 22. In this configuration, it can be useful to include additional features that can facilitate the orientation of the first and the third stretch films 10, 36 in the desired overlapping configuration. The first stretch film 10 and the third stretch film 36 are provided on a single spool 35. In other implementations, first stretch film 10 and the third stretch film 36 are provided on respective spools. The film rolls that are provided on the single spool 35 are spaced apart from each other, and such spacing can be the same for each pair of adjacent film rolls or can be different (e.g., one pair of rolls is spaced apart greater than another of the pairs of film rolls). The spacings between the rolls provided on a same spool can be provided in order to facilitate certain wrapping and/or edging and/or roping patterns.

The first stretch film roll 22 and the third stretch film roll 34 can also be replaced by a single stretch film roll that is cut in a middle section thereof, in order to obtain two sections: an upper section and a lower section, the upper and lower sections allowing to obtain the desired combined film.

Third Stretch Film Fully Overlapping Two Other Stretch Films

In some implementations, a third stretch film is provided in combination with two other stretch films partially overlapping each other. The third stretch film is roped, and the rope is positioned to fully overlap the double-ply band formed by the partial overlap of the first and second stretch films.

Figure 8:
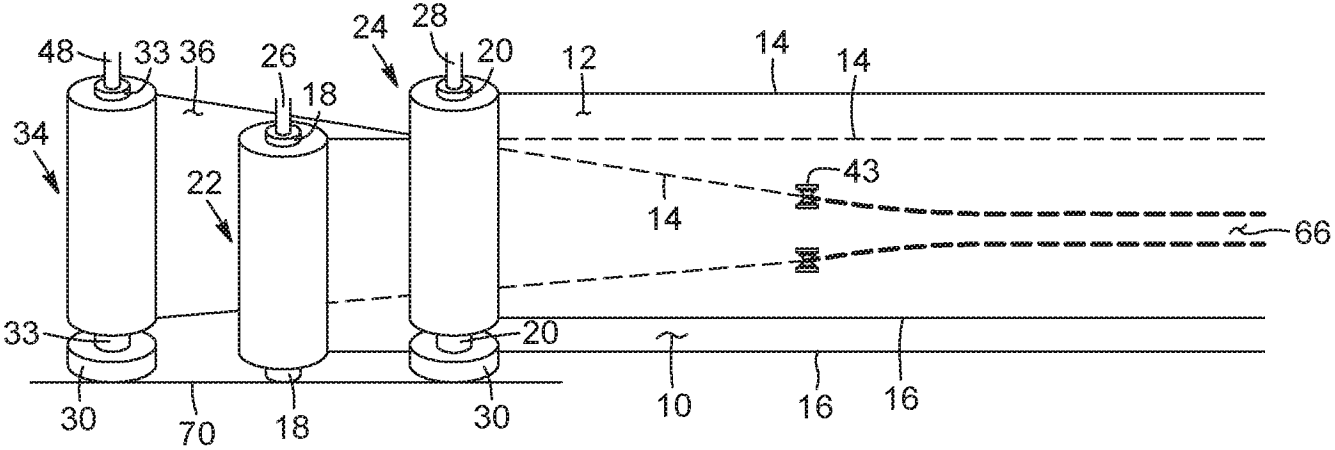
FIG. 8 is a schematic representation of a first stretch film, a second stretch film and a third stretch film positioned according to an embodiment, wherein the second stretch film partially overlaps the second stretch film, and the third stretch film is roped and fully overlapping a double-ply band formed by the first stretch film and the second stretch film.

With reference to FIG. 8, there is shown an embodiment in which the third stretch film 36 has both of the upper lateral side edge 14 and the lower lateral side edge 16 edged, thereby forming a rope 66. The rope 66 of the third stretch film 36 fully overlaps the double-ply band formed by the first stretch film 10 and the second stretch film 12.

Variable Widths of the Ropes

In some implementations, a stretch film can be combined with ropes having different widths.

Figure 11:
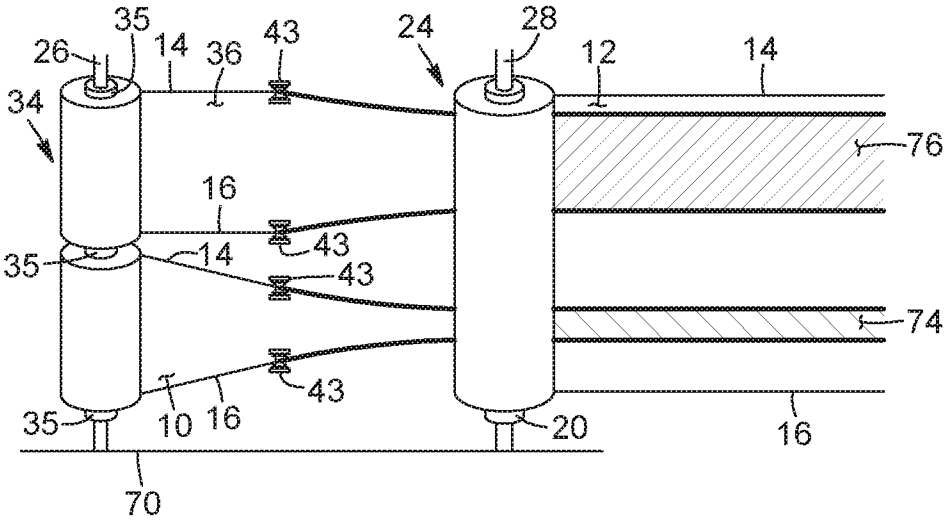
FIG. 11 is a schematic representation of a first stretch film, a second stretch film and a third stretch film positioned according to an embodiment, wherein the first stretch film and the third stretch film are roped to form a first rope and a third rope respectively, the first rope being wider than the third rope.

With reference to FIG. 11, there is shown an embodiment in which both the first stretch film 10 and the third stretch film 36 are roped to form a first rope 74 and a third rope 76, respectively. The first rope 74 is wider than the third rope 76. Varying the width of the ropes 74, 76 can contribute to providing a different type of protection along the height of the combined film. In some implementations, a fourth stretch film could be provided to form a fourth rope that could have a width similar to the width of one of the first and third rope 74, 76, or have a different width. It is to be understood that the "first", the "third" and the "fourth" ropes are so called in reference to the appellation of the respective stretch film rolls, and does not imply that there are three or fourth ropes present. In some implementations, the ropes of variable widths can be obtained from a first stretch film, cut into sections along the length of the stretch film and edged on both lateral side edges to form ropes of different widths, fully overlapping a second stretch film. In some implementations, a first stretch film can be cut into sections along the length of the stretch film, and the sections can be edged or roped to form edged sections and/or ropes of a given width, and as the first stretch film is stretched wrapped around a palletized load, the given width of the edged sections and/or ropes can vary. For instance, at the beginning of a stretch wrapping operation, the ropes can be relatively narrow, and can become wider as the stretch wrapping operation progressed, for instance by varying the position of the rollers.

Types of Edging and Roping

Figure 14:
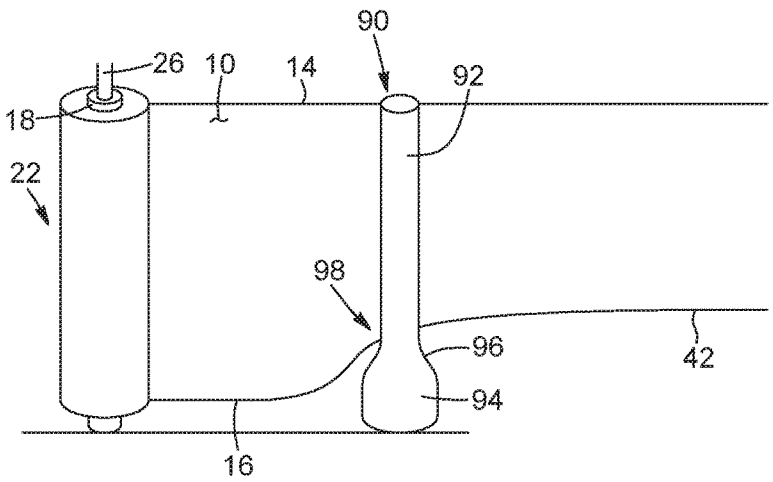
FIG. 14 is a schematic representation of a stretch film according to an embodiment, wherein a lower lateral side edge of the stretch film is edged with a roller having one edging unit.
Figure 15:
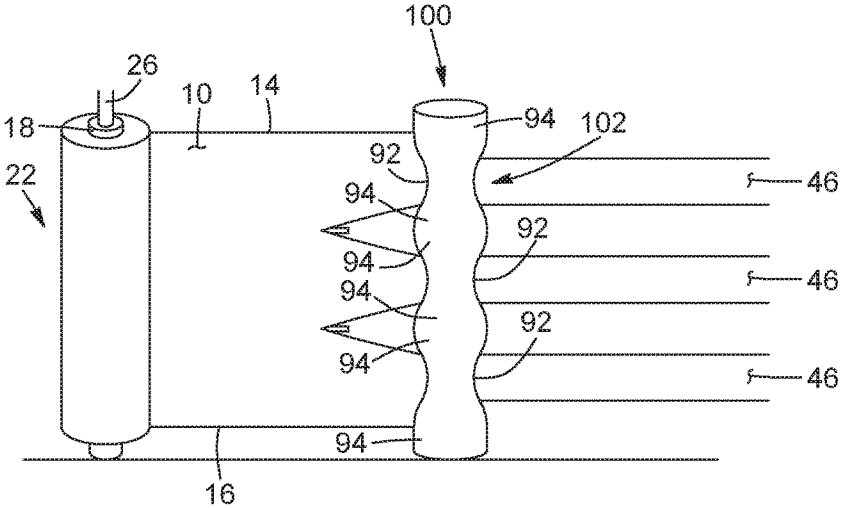
FIG. 15 is a schematic representation of a stretch film according to an embodiment, wherein the stretch film is cut to form three single ply bands that are roped using a roller having three roping units.

An edged lateral side edge of a stretch film and a rope of a stretch film can have various characteristics depending on the technique or the device used to edge or rope the stretch film. In some implementations, the lateral side edge of the stretch film can be rolled on itself to form a curly-type edged lateral side edge. With reference to FIGS. 14 and 15, the curly-type edge can be obtained using for instance a roller 90 having a substantially cylindrical shape and including portions having different diameters, the roller extending upwardly in the same orientation as the stretch film roll and positioned next to the stretch film roll when the roller is in use. The roller thus includes a receiving stretch film portion 92 and an edging portion 94, the receiving stretch film portion having a smaller diameter than the edging portion. In the embodiment shown, the transition between the receiving stretch portion and the edging portion is beveled 96. The transition between the receiving stretch film portion 92 and the edging portion 94 edges a lower lateral side edge 16 of the stretch film 10, since the stretch film 10 is forced to pass through a path having a given width. Thus, this configuration of the roller 90 can be used for instance to edge one lateral side edge of a stretch film such as shown in FIG. 1. The combination of one receiving stretch film portion 92 and one edging portion 94 is referred herein as an edging unit 98 of the roller. In some implementations, the roller 90 rotates in the same direction as the unwinding of the stretch film.

In some implementations, the receiving stretch film portion 92 is between two edging portions 94 so as to form an hourglass shaped roller to edge both lateral side edges of the stretch film and thus to form a rope 46. The distance between the two edging portions 94 of the roller influences the width of the resulting rope 46. The combination of one receiving stretch film portion 92 and two edging portions 94 is referred herein as a roping unit of the roller 102.

In some implementations, the roller can include more than one roping unit 102. The number of roping units can correspond for instance to the number of sections of a same stretch film that is cut in a given number of single ply bands. For instance, with reference to FIG. 7, a roller having two roping units could be used to form the upper rope 62 and the lower 64. With reference to FIG. 15, a roller 100 having three roping units 102 is shown, thus forming three ropes 46.

It is to be understood that any combination of edging units and roping units can be used depending of the desired edging or roping configuration of the stretch film.

In other implementations, the lateral edge of the stretch film can be bunched up in a zig zag-type edged lateral side edge. The zig zag-type edging can be obtained using a pulley or a roller that directs the edge of the stretch film to condense the stretch film in a longitudinal direction.

Variable Tension Applied on the Stretch Films

Once the desired configuration of the combined stretch film is obtained with regard to parameters such as the number of stretch films used, the extent of the offset of the stretch films relative to one another and the number of edged sides if any, the combined stretch film is fed to a pre-stretcher apparatus to be stretched prior to being wrapped around the palletized load. As mentioned above, one of the characteristics of the stretch film is its elastic recovery following stretching. This property allows the stretch film to keep the items of the palletized load tightly bound to each other, thereby stabilizing the palletized load.

As the stretch film is stretch wrapped around the palletized load, the tension applied on the various stretch film components forming the combined stretch film can vary. For instance, the stretch film that is neither edged or roped can be stretch wrapped around the palletized load under a given tension X, and the stretch film that is edged or roped can be stretch wrapped under a tension Y that is higher than tension X. This can be done at least in part because a stretch film that is edged or roped can sustain a higher tension before rupturing. This can allow to tighten the palletized load under a higher tension, and/or prevent a tear from propagating further than the closest edged lateral side edge. The tension at which the stretch film is applied around the palletized load can also vary along the height of the palletized load. For instance, the stretch film (or the combined stretch film) can be stretch under a given tension A as it is stretch wrapped around a bottom section and a top section of the palletized load, and to a looser tension B as it is stretch wrapped around a middle section of the palletized load, or vice-versa.

Adjustable Edging and Roping

In some implementations, the width of an edged stretch film or of a rope can be varied for a single palletized load. For example, the positioning of the guide(s) or roller(s) involved in the edging or roping of the stretch film around the palletized load can vary during a single stretch wrapping operation. In order to do so, the guide(s) or roller(s) can be translated along a vertical axis using an automated system translating the guide(s) or roller(s) according to a given pattern. For instance, the given pattern can be determined according to the characteristics of the palletized load. In some implementations, adjustable edging or roping can be useful when different stretch wrapping patterns are desired to be applied to the palletized load. For example, a thinner rope may be desired when the stretch film is applied in an "X" pattern in a first wrapping operation, followed by circumvolutions of a wider edged stretch film that are substantially parallel to one another in a second wrapping operation, still for the same palletized load.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A method for securing a palletized load, the method comprising the steps of:

dispensing a first stretch film having a first width, a first upper lateral side edge and a first lower lateral side edge from a first stretch film roll inserted over a first support member extending from a base surface;

dispensing a second stretch film having a second width, a second upper lateral side edge and a second lower lateral side edge from a second stretch film roll inserted over a second support member provided in a side-by-side relationship relative to the first support member;

wherein the first stretch film roll is configured to extend at an angle from the base surface to edge the first upper lateral side edge;

partially or fully overlapping the second stretch film and the first stretch film, comprising positioning the second upper lateral side edge of the second stretch film at a given height relative to the first upper lateral side edge of the first stretch film to form a combined stretch film;

passing the combined stretch film through a pre-stretcher; and wrapping the combined stretch film around the palletized load.

2. The method of claim 1, further comprising:

edging at least one of the second upper lateral side edge and the second lower lateral side edge of the second stretch film to obtain an edged second stretch film.

3. The method of claim 2, wherein at least one of the first support member and the second support member comprises at least one height adjustment device to adjust the given height of the edged second stretch film along the first width of the first stretch film.

4. The method of claim 3, wherein the at least one height adjustment device comprises at least one of a puck, a block or a spacer.

5. The method of claim 3, wherein the at least one height adjustment device is configured to be insertable over a corresponding one of the first support member and the second support member or to be laterally translatable around the corresponding one of the first support member and the second support member.

6. The method of claim 2, wherein edging the at least one of the second upper lateral side edge and the second lower lateral side edge of the second stretch film comprises using at least one of a guide, a roller and a pulley.

7. The method of claim 2, wherein edging the at least one of the upper lateral side edge and the lower lateral side edge of the second stretch film comprises curling or bunching the at least one of the upper lateral side edge and a lower lateral side edge of the second stretch film.

8. The method of claim 1, further comprising the steps of:

dispensing a third stretch film having a third lateral upper lateral side edge and a third lower lateral side edge from a third stretch film roll inserted over the first support member or over a third support member; and partially or fully overlapping the third stretch film and the second stretch film, comprising positioning the third stretch film at a given height along the first width of the first stretch film to form a triple-band ply.

9. The method of claim 8, further comprising edging at least one of the third upper lateral side edge and the third lower lateral side edge of the third stretch film.

10. The method of claim 9, wherein both of the third upper lateral side edge and the third lower lateral side edge of the third stretch film are edged to form a rope, and the rope is positioned within a width of the combined stretch film.

11. The method of claim 1, wherein passing the combined stretch film through a pre-stretcher comprises pre-stretching the combined stretch film under at least two different tensions along a height of the palletized load.

12. The method of claim 1, further comprising adjusting the angle of the first stretch film roll to control a tension of the first upper lateral side edge of the first stretch film.

13. A method for securing a palletized load, the method comprising the steps of:

dispensing a first stretch film having a first width, a first upper lateral side edge and a first lower lateral side edge from a first stretch film roll;

dispensing a second stretch film having a second width and a second upper lateral side edge from a second stretch film roll, the second width being larger than the first width;

cutting the second stretch film along a length thereof to obtain an upper section and a lower section;

partially overlapping the first stretch film and the second stretch film, comprising positioning the upper section over the first upper lateral side edge of the first stretch film, and positioning the lower section over the first lower lateral side edge of the first stretch film;

passing the partially overlapped films through a pre-stretcher; and wrapping the combined stretch film around the palletized load.

14. The method of claim 13, further comprising forming a first rope with the upper section of the first stretch film and a second rope with the lower section of the second stretch film.

15. The method of claim 14, wherein the first rope or the second rope are provided with a respective width that is different from each other.

16. The method of claim 13, wherein the first stretch film is inserted substantially vertically over a first support member and the second stretch film is inserted substantially vertically over a second support member.

17. The method of claim 13, wherein the first stretch film and the second stretch film are inserted over a same support member.

18. The method of claim 13, wherein forming the first rope or the second rope comprises using a roller having a least one rolling unit.

19. A method for securing a palletized load, the method comprising the steps of:

dispensing a first stretch film having a first upper lateral side edge and a first lower lateral side edge from a first stretch film roll vertically inserted over a first support member;

dispensing a second stretch film having a second upper lateral side edge and a second lower lateral side edge from a second stretch film roll inserted over a second support member;

partially overlapping the second stretch film and the first stretch film by positioning the second upper lateral side edge at a given height above the first upper lateral side edge to obtain a combined stretch film and such that each of the first and second stretch films comprises a single-layer portion relative to each other;

dispensing a third stretch film having a third upper lateral side edge and a third lower lateral side edge from a third stretch film roll so as to form an upper double-ply band, a lower double-ply band, and a triple-ply band therebetween, the first, second and third stretch rolls being provided in a side-by-side relationship;

passing the partially overlapped films through a pre-stretcher; and wrapping the combined stretch film and the third stretch film simultaneously around the palletized load.

20. The method of claim 19, further comprising edging at least one of the first upper lateral side edge and the third lower lateral side edge.

21. The method of claim 19, further comprising edging at least one of the second upper lateral side edge and the second lower lateral side edge of the second stretch film roll.

22. The method of claim 19, wherein partially overlapping the second stretch film and the first stretch film by positioning the second upper lateral side edge at a given height above the first upper lateral side edge comprises adjusting the given height using at least one height adjustment device placed underneath the second stretch film roll.

* * * * *